US010975330B2

(12) United States Patent
Kim

(10) Patent No.: US 10,975,330 B2
(45) Date of Patent: Apr. 13, 2021

(54) GEL-TYPE SCENTED CANDLE AND METHOD FOR MANUFACTURING SAME

(71) Applicant: Hae Ju Kim, Seoul (KR)

(72) Inventor: Hae Ju Kim, Seoul (KR)

( * ) Notice: Subject to any disclaimer, the term of this patent is extended or adjusted under 35 U.S.C. 154(b) by 0 days.

(21) Appl. No.: 16/624,290

(22) PCT Filed: Jun. 28, 2018

(86) PCT No.: PCT/KR2018/007325

§ 371 (c)(1),
(2) Date: Dec. 18, 2019

(87) PCT Pub. No.: WO2019/004737

PCT Pub. Date: Jan. 3, 2019

(65) Prior Publication Data

US 2020/0109349 A1 Apr. 9, 2020

(30) Foreign Application Priority Data

Jun. 30, 2017 (KR) ..... 10-2017-0083353

(51) Int. Cl.
*C11C 5/00* (2006.01)

(52) U.S. Cl.
CPC ..... *C11C 5/008* (2013.01); *C11C 5/002* (2013.01); *C11C 5/004* (2013.01); *C11C 5/006* (2013.01)

(58) Field of Classification Search
CPC . C11C 5/00; C11C 5/002; C11C 5/004; C11C 5/006; C11C 5/008
See application file for complete search history.

(56) References Cited

U.S. PATENT DOCUMENTS

| | | | | |
|---|---|---|---|---|
| 6,129,771 | A | 10/2000 | Ficke et al. | |
| 2011/0030714 | A1* | 2/2011 | Iijima | A61H 37/00 132/200 |
| 2016/0281030 | A1* | 9/2016 | Grimm | C11C 5/002 |

FOREIGN PATENT DOCUMENTS

| | | | |
|---|---|---|---|
| CN | 104305180 | A * | 1/2015 |
| JP | 2014-047315 | A | 3/2014 |
| KR | 20070013523 | A * | 1/2007 |
| KR | 10-2010-0039587 | A | 4/2010 |
| KR | 10-0961496 | B1 | 6/2010 |
| KR | 2010039587 | A * | 4/2020 |

OTHER PUBLICATIONS

International Search Report for PCT/KR2018/007325 dated Nov. 1, 2018 from Korean Intellectual Property Office.

* cited by examiner

*Primary Examiner* — Latosha Hines
(74) *Attorney, Agent, or Firm* — Revolution IP, PLLC

(57) ABSTRACT

A gel-type scented candle includes a container, a wick attached to and erected at the center of the inner bottom of the container, and a candle oil accommodated in the container, in which the candle oil is of a gel type made by adding a natural vegetable oil with a natural perfume and a natural pigment, and the container can be reused by being refilled with the candle oil by a user before or after use of the candle oil.

4 Claims, 3 Drawing Sheets

[FIG. 1]
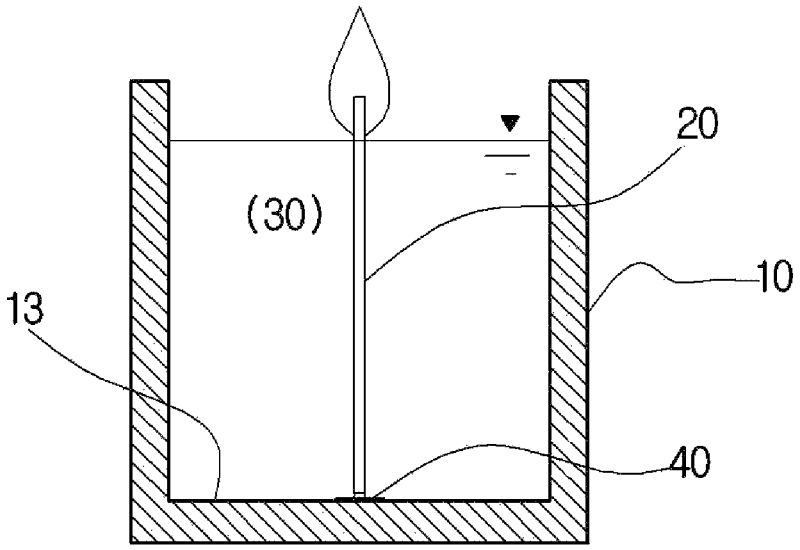
[FIG. 2]
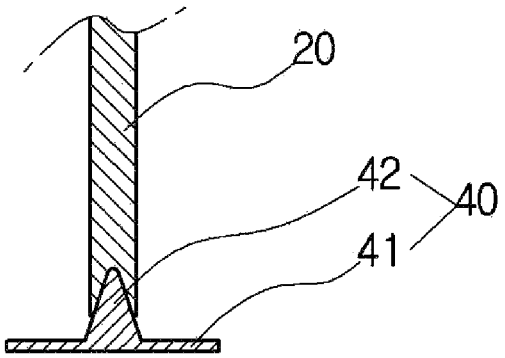

[FIG. 3]
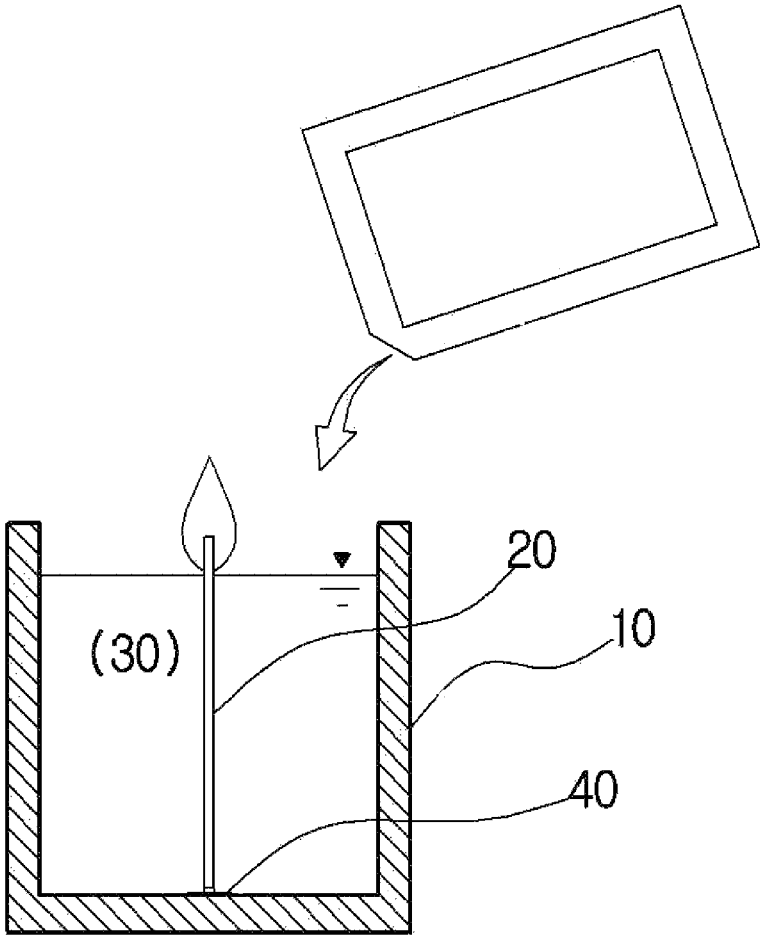

[FIG. 4]
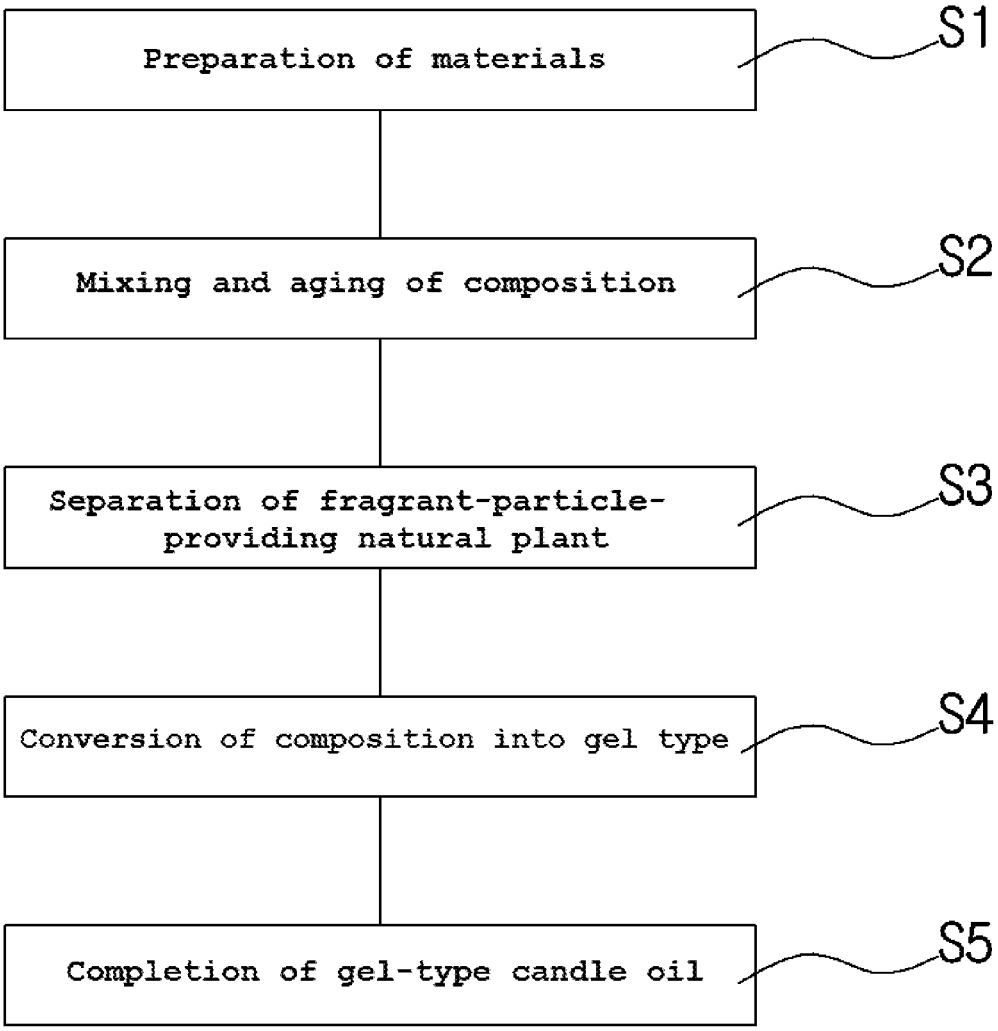

GEL-TYPE SCENTED CANDLE AND METHOD FOR MANUFACTURING SAME

TECHNICAL FIELD

The present invention relates to a gel-type scented candle and a method of manufacturing the same, and more particularly to a gel-type scented candle, which has physical properties enabling the scented candle to be contained in a desired container at any time and is made of harmless and inexpensive natural materials and may thus be safely and conveniently used by users, and a method of manufacturing the same.

BACKGROUND ART

In general, typical candles are widely used as interior accessories such as decorative candles for the interior and scented candles that provide fragrance, in addition to the function of providing light.

However, such candles are single-use consumer goods, and candles made of wax are dirty after burning, causing a problem with the function thereof as an accessory for decoration. Moreover, remnants resulting from burning of the candle become unrecyclable waste, undesirably incurring environmental pollution.

Accordingly, decorative candles using paraffin oil or the like, which are added with fragrance, have been provided in recent years.

However, conventional candles made of paraffin (scented candles) are increasingly ignored by consumers because they include harmful substances, whether solid or liquid.

A liquid paraffin jelly scented candle includes harmful substances, and the jelly is not soft, which makes it difficult to replace or change the container thereof.

Moreover, a natural solid candle is easily provided in the form of being contained in a typical container, but is problematic in that most glass containers containing such candles therein are not recycled after use but are discarded.

Such conventional scented candles are not formed with 100% natural materials due to the inclusion of paraffin, and cannot be contained in various containers, whether liquid or solid. Additionally, when scented candles made of natural materials are provided, the price thereof is high, imposing an economic burden on the manufacturers of scented candles and on the consumers who purchase scented candles.

Therefore, it is necessary to provide a scented candle, particularly a gel-type scented candle, which includes inexpensive natural materials and may be stably and easily contained in a variety of containers.

DISCLOSURE

Technical Problem

Accordingly, the present invention has been made keeping in mind the problems encountered in the related art, and an objective of the present invention is to provide a gel-type scented candle, which has physical properties enabling the scented candle to be contained in a desired container at any time.

Another objective of the present invention is to provide a gel-type scented candle, which may be made of harmless natural materials and may thus be safely and conveniently used by consumers.

Still another objective of the present invention is to provide a gel-type scented candle, which may be made of inexpensive natural materials and may thus be safely and conveniently used by consumers.

Yet another objective of the present invention is to provide a gel-type scented candle, which is in a watery form, whereby a container may be reused by being continuously refilled with the scented candle even after use of the scented candle contained in the container.

Still yet another objective of the present invention is to provide a gel-type scented candle, which may be contained in a variety of containers and in which refilling with the gel-type scented candle is possible to thus enable reuse of the containers, and moreover, candle remnants may be prevented from being left behind, whereby the periphery of the scented candle may be kept clean.

Therefore, the present invention has been devised to solve the conventional problems described above, and a further objective of the present invention is to provide a method of manufacturing a gel-type scented candle, which has physical properties enabling the scented candle to be contained in a desired container at any time.

Technical Solution

In order to accomplish the above objectives, the present invention provides a gel-type scented candle, including a container, a wick attached to and erected at the center of the inner bottom of the container, and a candle oil accommodated in the container, in which the candle oil is of a gel type, made by adding a natural vegetable oil with a natural perfume and a natural pigment, and the container may be reused by being refilled with the candle oil by a user before or after use of the candle oil.

Also, the wick may be configured such that a natural cotton is coated with the candle oil, and may be fixedly provided by a wick-fixing tap attached so as to be erected on the inner bottom of the container.

Also, the wick-fixing tap may include a tap body attached to the inner bottom of the container using a glue gun or double-sided tape and a wick support formed to protrude from the center of the tap body so as to allow the wick to be erected.

Also, the candle oil may be composed of a gel-type candle oil, made by mixing the natural vegetable oil with a fragrant-particle-providing natural plant, candelilla wax, the natural pigment, propolis, and an essential oil.

In addition, the present invention provides a method of manufacturing a gel-type scented candle, the method including preparing a natural vegetable oil and a dried and pulverized fragrant-particle-providing natural plant (S1), mixing and aging a composition by adding and mixing the natural vegetable oil with the fragrant-particle-providing natural plant and maintaining the mixture at a predetermined temperature for a predetermined period of time so that the oil is blended with a base fragrance (S2), separating the fragrant-particle-providing natural plant from the composition (S3), converting the composition into a gel type by adding and mixing the composition with a natural wax, a natural pigment and an antioxidant and performing heating in a water bath (S4), and completing a gel-type candle oil by adding and mixing the composition with a natural essential oil (S5).

Also, in the mixing and aging the composition (S2), the natural vegetable oil may be mixed with 15 wt % of the fragrant-particle-providing natural plant, maintained at a temperature of 40 to 50° C., and aged and mixed for 48 hr.

Also, in the separating the fragrant-particle-providing natural plant from the composition (S3), after mixing of the composition, the aged oil and fragrant particles may be placed in a mixing tank and warmed in a water bath to 60° C., thereby separating the fragrant particles.

Also, in the converting the composition into the gel type (S4), after separation of the fragrant particles, the composition may be added with 2 wt % of candelilla wax in a mixing tank and warmed to 70° C. and thus completely dissolved, mixed with 3 wt % of the natural pigment and dissolved, and added and mixed with 2 wt % of a preservative (antioxidant) in a water bath at 60° C.

Also, in the completing the gel-type candle oil (S5), when the temperature of the oil, which is the composition, is 60° C., 2 wt % of the natural essential oil based on the weight of the oil may be added and stirred, thus obtaining a gel-type oil.

Advantageous Effects

According to the present invention, there is provided a gel-type scented candle, which has physical properties enabling the scented candle to be contained in a desired container at any time.

Also, according to the present invention, the gel-type scented candle can be made of harmless natural materials and can thus be safely and conveniently used by consumers.

Also, according to the present invention, the gel-type scented candle can be made of inexpensive natural materials and can thus be safely and conveniently used by consumers.

Also, according to the present invention, the gel-type scented candle is in a watery form and thus a container can be reused by being continuously refilled with the scented candle even after use of the gel-type scented candle contained in the container.

Also, according to the present invention, the gel-type scented candle can be contained in a variety of containers and refilling with the scented candle is possible to thus enable reuse of the containers, and moreover, candle remnants can be prevented from being left behind, whereby the periphery of the scented candle can be kept clean.

Also, according to the present invention, the candle wick can be easily installed in the container that accommodates the scented candle regardless of the shape of the container, and moreover, the wick flame, which floats in liquid oil, can be used stably and continuously.

BRIEF DESCRIPTION OF DRAWINGS

FIGS. 1 to 4 show the gel-type scented candle according to an embodiment of the present invention;

FIG. 1 shows the overall configuration of the gel-type scented candle according to the present invention;

FIG. 2 is an expanded view showing the attachment of a wick in the gel-type scented candle according to the present invention;

FIG. 3 shows the use of the gel-type scented candle according to the present invention; and FIG. 4 is a flowchart showing a process of manufacturing a gel-type scented candle according to the present invention.

MODE FOR INVENTION

Hereinafter, a detailed description will be given of preferred embodiments of the present invention with reference to the accompanying drawings.

The present invention is not limited to the embodiments described herein but may be embodied variously. The embodiments of the invention are rather provided so that the disclosed contents become thorough and complete and the spirit of the present invention may be sufficiently transferred to those skilled in the art.

The preferred embodiments of the present invention are described in detail below with reference to the accompanying drawings. In adding reference numerals to the components of the drawings, it should be noted that the same reference numerals are used as much as possible even when appearing in different drawings. Moreover, in describing the present invention, if it is determined that a detailed description of a related known configuration or function may obscure the subject matter of the present invention, the detailed description thereof will be omitted.

FIGS. 1 to 4 show the gel-type scented candle according to an embodiment of the present invention.

With reference to FIGS. 1 to 3, the gel-type scented candle according to the present invention is configured to include a container 10, a wick 20 attached to and erected at the center 11 of the inner bottom of the container 10, and a candle oil 30 accommodated in the container 10.

The container 10 is provided in a typical vessel form, in which the wick 20 is installed to be erected through the open top thereof and the inner space thereof may be filled with the candle oil 30.

The wick 20 is configured such that a natural cotton is coated with the candle oil, and is fixedly provided by a wick-fixing tap 40 attached so as to be erected on the inner bottom of the container 10.

The wick-fixing tap 40 may include a tap body 41 attached to the inner bottom of the container using a glue gun or double-sided tape and a wick support 42 formed to protrude from the center of the tap body so as to allow the wick to be erected.

Preferably, the wick-fixing tap 40 is provided in a plate structure made of a silicone material.

The candle oil 30 may be of a gel type in which the natural vegetable oil is added with a natural perfume and a natural pigment. Before or after use of the candle oil, the container may be refilled with the candle oil by the user and may thus be reused.

The candle oil 30 may be provided in the form of a gel-type composition obtained by mixing 78 wt % of a natural vegetable oil, 15 wt % of a fragrant-particle-providing natural plant, 2 wt % of candelilla wax, 1 wt % of a natural pigment, 2 wt % of propolis, and 2 wt % of an essential oil.

Preferably, the natural vegetable oil is any one selected from among vegetable oils having high melting points, such as canola oil, citron oil, plum oil, palm oil and the like.

Preferably, the fragrant-particle-providing natural plant is any one selected from among herbaceous plant, rosemary, apple mint, and lavender plant.

Also, the fragrant-particle-providing natural plant may be any one selected from among fruit peel, mugwort, and cinnamon.

Here, the perfume included in the gel-type natural oil scented candle may include various perfumes that may produce an aroma effect known in the art, and it is preferable to use a natural essential oil.

Hereinafter, the process of manufacturing the gel-type scented candle according to the present invention and the effects thereof are described, and with reference to the above configuration, a description is given below.

In the manufacture of the gel-type scented candle, a natural vegetable oil and a dried and pulverized fragrant-particle-providing plant are prepared, and specifically, a 100% natural vegetable oil, and a plant containing fragrant particles, which is dried, fermented and pulverized, are prepared (S1).

Here, the natural vegetable oil may include any oil having a high melting point, such as canola oil, citron oil, plum oil, palm oil and the like, and any one selected from among natural oils may be used. Also, the fragrant-particle-providing plant is a plant containing fragrant particles, and may include any one selected from among herbaceous plant, mugwort, cinnamon and fruit peel, which are easy to obtain.

Next, the composition is mixed and aged from the prepared materials, and specifically, the natural vegetable oil is added and mixed with 15 wt % of the fragrant-particle-providing natural plant, maintained at a temperature of 40 to 50° C., and aged for 48 hr so that the oil is blended with the base fragrance (S2).

Next, the fragrant-particle-providing natural plant is separated from the composition, and specifically, after mixing of the composition, the aged oil and fragrant particles are placed in a mixing tank and then warmed to 60° C., followed by separating the fragrant particles (S3).

Next, the composition is converted into a gel type, and specifically, 2 wt % of candelilla wax based on the weight of the oil is placed in a mixing tank and warmed to 70° C. to thus be completely dissolved, after which 1 wt % of a natural pigment based on the weight of the oil is added thereto and dissolved, after which 2 wt % of a preservative (antioxidant) based on the weight of the oil is added and mixed in a water bath at 60° C. (S4).

Thereafter, a gel-type candle oil is completed, and specifically, when the temperature of the oil, which is the composition, is maintained at 60° C., 2 wt % of a natural essential oil based on the weight of the oil is added thereto and stirred, thereby completing a gel-type candle oil.

Furthermore, the wick 20 is immersed in the gel-type natural oil composition warmed in the water bath, taken out therefrom, and dried.

Next, the dried wick 20 is cut to be longer than or equal to the height of the container 10, the wick is attached to the wick-fixing tap 40, and then the wick-fixing tap 40 is fixed to the center of the container 10 using a glue gun or double-sided tape.

Finally, the gel-type natural oil composition warmed in the water bath is loaded in the container 10, thereby providing a gel-type scented candle.

Meanwhile, the plant containing fragrant particles may include all kinds of fragrant plants such as fruit peel, herbaceous plant leaf, mugwort, cinnamon and the like. In addition, although the vegetable oil may be mixed with the fragrant particles, a pure vegetable oil may be added after separation of the fragrant particles, depending on whether or not the base fragrance is added.

Also, the perfume included in the gel-type natural oil scented candle may include a variety of perfumes that may produce an aroma effect known in the art, and preferably a natural essential oil is used.

Also, an open-topped container may be provided in various shapes using various materials. Examples of the shape thereof may include a circular shape, a triangular shape, a rectangular shape, a star shape, and the like, and examples of the material thereof may include glass, wood, concrete, and the like.

The gel-type scented candle according to the present invention as described above can not only reflect the current lifestyle and trends that prioritize health due to the use of 100% natural materials, but also makes it possible to provide a variety of products in a soft gel form.

Moreover, because the container is reused, it is possible to diversify the development of the container design, thereby enhancing the competitiveness of the product and even the competitiveness of the company and brand, and moreover, various vegetable oils can be used in place of raw materials that depend on imports, resulting in cost savings and increased product productivity.

Although the preferred embodiments of the present invention have been disclosed for illustrative purposes, those skilled in the art will appreciate that various modifications, additions and substitutions are possible without departing from the scope and spirit of the invention as disclosed in the accompanying claims.

INDUSTRIAL APPLICABILITY

According to the present invention, there is provided a gel-type scented candle, which has physical properties enabling the scented candle to be contained in a desired container at any time.

Also, according to the present invention, the gel-type scented candle is made of harmless natural materials and can thus be safely and conveniently used by consumers.

Also, according to the present invention, the gel-type scented candle is made of inexpensive natural materials and can thus be safely and conveniently used by consumers.

Also, according to the present invention, the gel-type scented candle is in a watery form and thus the container can be reused by being continuously refilled with the scented candle even after use of the gel-type scented candle contained in the container.

Also, according to the present invention, the gel-type scented candle can be provided in various containers and refilling with the scented candle is possible to thus enable reuse of the containers, and moreover, candle remnants can be prevented from being left behind, whereby the periphery of the scented candle can be kept clean.

Also, according to the present invention, the candle wick can be easily installed in the container that accommodates the scented candle regardless of the shape of the container, and the wick flame, which floats in liquid oil, can be used stably and continuously.

The invention claimed is:

1. A method of manufacturing a gel-type scented candle, the method comprising:

preparing a natural vegetable oil and a dried and pulverized fragrant-particle-providing natural plant (S1);

mixing and aging a composition by adding and mixing the natural vegetable oil with the fragrant-particle-providing natural plant and maintaining a mixture at a predetermined temperature for a predetermined period of time so that the oil is blended with a base fragrance (S2), wherein the natural vegetable oil is mixed with 15 wt % of the fragrant-particle-providing natural plant based on the composition, maintained at a temperature of 40 to 50° C., and aged and mixed for 48 hr;

separating the fragrant-particle-providing natural plant from the composition (S3);

converting the composition into a gel type by adding and mixing the composition with a natural wax, a natural pigment and an antioxidant and performing heating in a water bath (S4); and completing a gel-type candle oil by adding the composition with a natural essential oil (S5) and performing mixing.

2. The method of claim 1, wherein in the separating the fragrant-particle-providing natural plant from the composition (S3), after mixing of the composition, the aged oil and fragrant particles are placed in a mixing tank and warmed in a water bath to 60° C., thereby separating the fragrant particles.

3. The method of claim 1, wherein, in the converting the composition into the gel type (S4), after separation of the fragrant particles, the composition is added with 2 wt % of candelilla wax based on the composition in a mixing tank and warmed to 70° C. and thus completely dissolved, mixed with 3 wt % of the natural pigment based on the composition and dissolved, and added and mixed with 2 wt % of a preservative based on the composition in a water bath at 60° C., wherein the preservative is antioxidant.

4. The method of claim 1, wherein, in the completing the gel-type candle oil (S5), when a temperature of the oil, which is the composition, is 60° C., 2 wt % of the natural essential oil based on the composition is added and stirred, thus obtaining a gel-type oil.

* * * * *